United States Patent [19]

Freisinger et al.

[11] Patent Number: 5,002,303

[45] Date of Patent: Mar. 26, 1991

[54] SKI BINDING

[75] Inventors: Henry Freisinger, Vienna; Hubert Wurthner, Hainburg; Karl Stritzl; Egon Brunnhuber, both of Vienna, all of Austria

[73] Assignee: TMC Corporation, Barr, Switzerland

[21] Appl. No.: 399,942

[22] Filed: Aug. 29, 1989

[30] Foreign Application Priority Data

Sep. 1, 1988 [AT] Austria ..... 2151/88

[51] Int. Cl.[5] ..... A63C 7/10

[52] U.S. Cl. ..... 280/605; 280/618

[58] Field of Search ..... 280/604, 618, 607, 617, 280/605

[56] References Cited

U.S. PATENT DOCUMENTS

| | | | |
|---|---|---|---|
| 4,061,357 | 12/1977 | Salomon | 280/618 X |
| 4,062,562 | 12/1977 | Riedel | 280/605 |
| 4,163,569 | 8/1979 | Horn | 280/618 X |
| 4,239,256 | 12/1980 | Krob et al. | 280/605 |
| 4,537,418 | 8/1985 | Knabel et al. | 280/605 |

FOREIGN PATENT DOCUMENTS

| | | | |
|---|---|---|---|
| 378917 | 10/1985 | Austria . | |
| 264664 | 4/1988 | European Pat. Off. | 280/605 |
| 2825876 | 1/1980 | Fed. Rep. of Germany . | |
| 3048175 | 7/1982 | Fed. Rep. of Germany . | |

*Primary Examiner*—Charles A. Marmor
*Assistant Examiner*—Michael Mar
*Attorney, Agent, or Firm*—Finnegan, Henderson, Farabow, Garrett & Dunner

[57] ABSTRACT

This touring binding has a sole plate, which can be pivoted about a pivot pin, fixed to the ski, and on which there are arranged a heel holder, a toe holding unit and a ski brake with two multiply angled-off brake spikes. In this arrangement there are provided in the sole plate, between the pivot pin and the heel holder, two bearings for the transversely running sections of the same, forming the pivot axis of the brake spikes.

In order to make a simple exchanging of the ski brake (10) possible in the case of this touring binding (2), the invention provides that each bearing is of split design in vertical direction, the lower bearing half (8*g*) being hollowed out as a depression in an upwardly open recess (8*e*) of the sole plate (8), and the upper bearing half (10*d*) being hollowed out in a bearing shell (10*c*), which can be inserted into the recess (8*e*) and can be fastened in the latter.

11 Claims, 4 Drawing Sheets

SKI BINDING

BACKGROUND OF THE INVENTION

1. Field of the Invention

The invention relates to a touring ski binding having a sole plate that is pivotable about a pin fixed to the ski.

2. Description of the Related Art

A known touring binding of this type is described in DE-Al-28 25 876. In the case of this ski binding, the ski brake is designed as an integral wire brake bow, which has two parallel bearing sections running transversely to the ski longitudinal direction. These bearing sections are held in place by a cover plate acting as retaining device, which is screwed onto the sole plate. A differently designed ski brake, for example with a pedal and with two mutually independent brake spikes, cannot be used in the case of the known ski binding.

The invention sets itself the object of eliminating this disadvantage and of creating a ski binding of the type mentioned at the beginning which makes possible in a simple way a fastening of a ski brake with a pedal and with two mutually independent brake arms.

A binding according to the present invention overcomes the disadvantages of the prior art. Due to the fact that, when mounting, only two bearing shells have to be removed from the sole plate, the ski brake can be removed in assembled state, without being dismantled, from the sole plate and replaced by a new one. Due to the fastening by means of a clamping claw, the use of additional screws for holding the upper bearing shells in place is not necessary.

The idea of coupling a ski brake to a heel holder is already known per se, as for example AT-A2-345 136 (FIGS. 3 and 4) shows. In the case of this design, the heel holder and the ski brake are guided on a guide rail fixed to the ski. The ski brake bears a tie rod with a hook-shaped end, with which it can be coupled to the guide plate for the heel holder.

AT-A2-378 917 shows a different design. In the case of this design, the bearing block of the ski brake bears a U-shaped wire bow, which can be pushed into the angled-off underlay plate of a heel holder and locked with respect to the latter. In the case of this design as well, underlay plate and heel holder can be adjusted jointly on a guide rail fixed to the ski and locked with respect to the said rail. However, both known designs of ski brakes are not suitable for use in the case of touring bindings with a sole plate.

DE-A2-30 48 175 discloses a combination of a ski binding and a ski brake in which the ski brake has a bearing part which has on its outer regions receptacles which serve for the detachable holding of the ski brake on the pivotal binding part designed as touring frame and in which a locking mechanism is provided on the bearing part, which mechanism holds the bearing part with respect to the longitudinal direction of the pivotal binding part in place on the latter.

This design is, however, bound to the use of a touring frame with two members, which have a circular cross section in each case. In the case of a sole plate, as is used in the case of the ski binding according to the invention, consequently this combination cannot be used.

An object of the present invention is to provide advantageous designs of the two lower and upper bearing halves.

Another object of the present invention is to prevent the encrustation of snow and dirt on the upper side of the sole plate.

An additional object of the present invention is to provide stability of the clamping claw, and thus the stability of the two bearing shells is increased.

A further object of the present invention is to ensure a particularly simple mounting of the ski brake.

SUMMARY OF THE INVENTION

To achieve the objects and advantages of the invention there is provided a ski binding for disposal on a sole plate which is pivotable on the upper surface of a ski, the ski binding comprising a ski brake including two brake arms pivotable about a pivot axis in a pivot opening, a lower bearing mounted on the pivotable sole plate, the lower bearing including lower groove means, substantially U-shaped in cross-section, for receiving the brake arms, an upper bearing removably mounted on the lower bearing, the upper bearing including upper groove means, substantially U-shaped in cross-section for cooperating with the lower groove means to define the pivot opening, and holding means for securing the upper bearing to the lower bearing, the holding means being selectively removable for allowing the brake arms to be removed from the pivot opening.

In the drawing, an exemplary design of the subject of the invention is reproduced.

Figure 2:
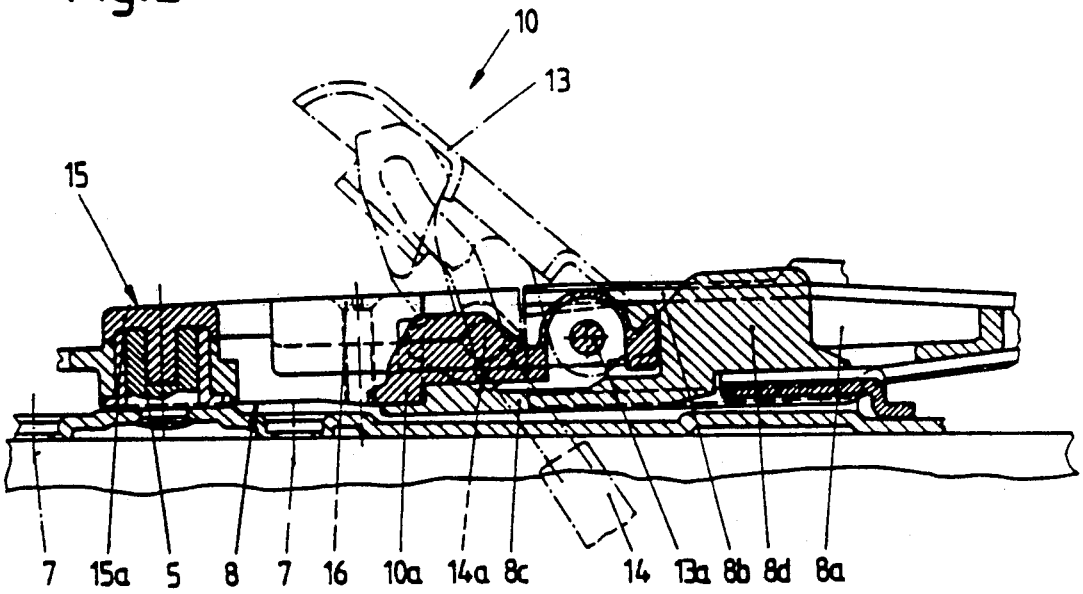
FIG. 2 is an enlarged detailed drawing of the ski binding shown in FIG. 1.
Figure 2A:
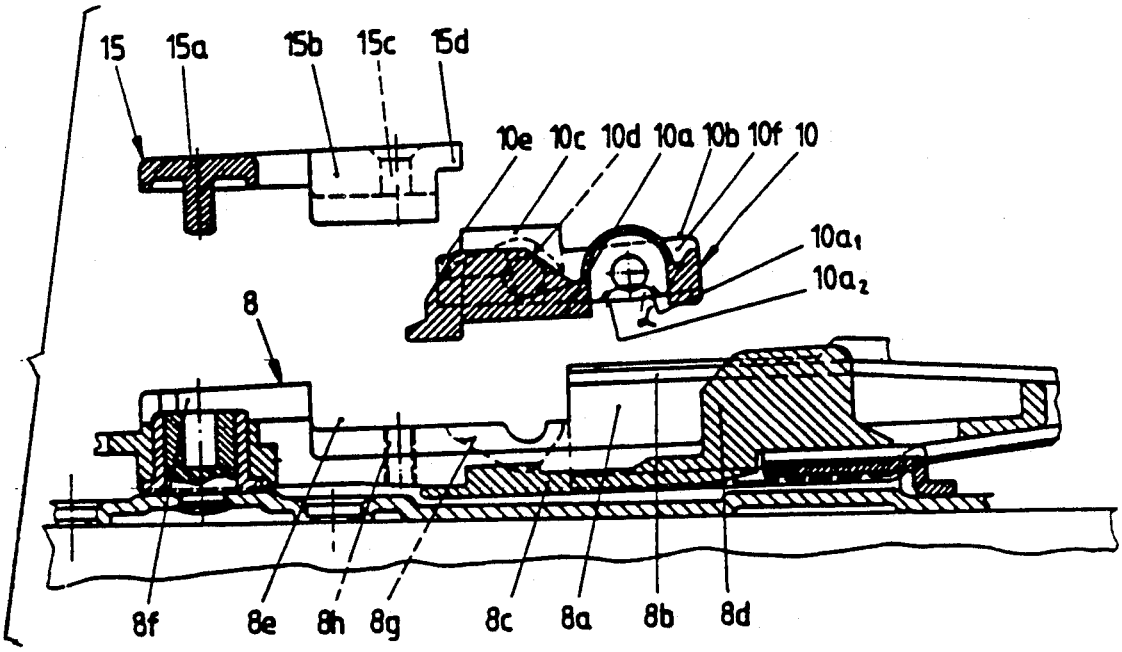

FIG. 2*a* is a an exploded view of the ski binding depicted in FIG. 2.

Figure 3:
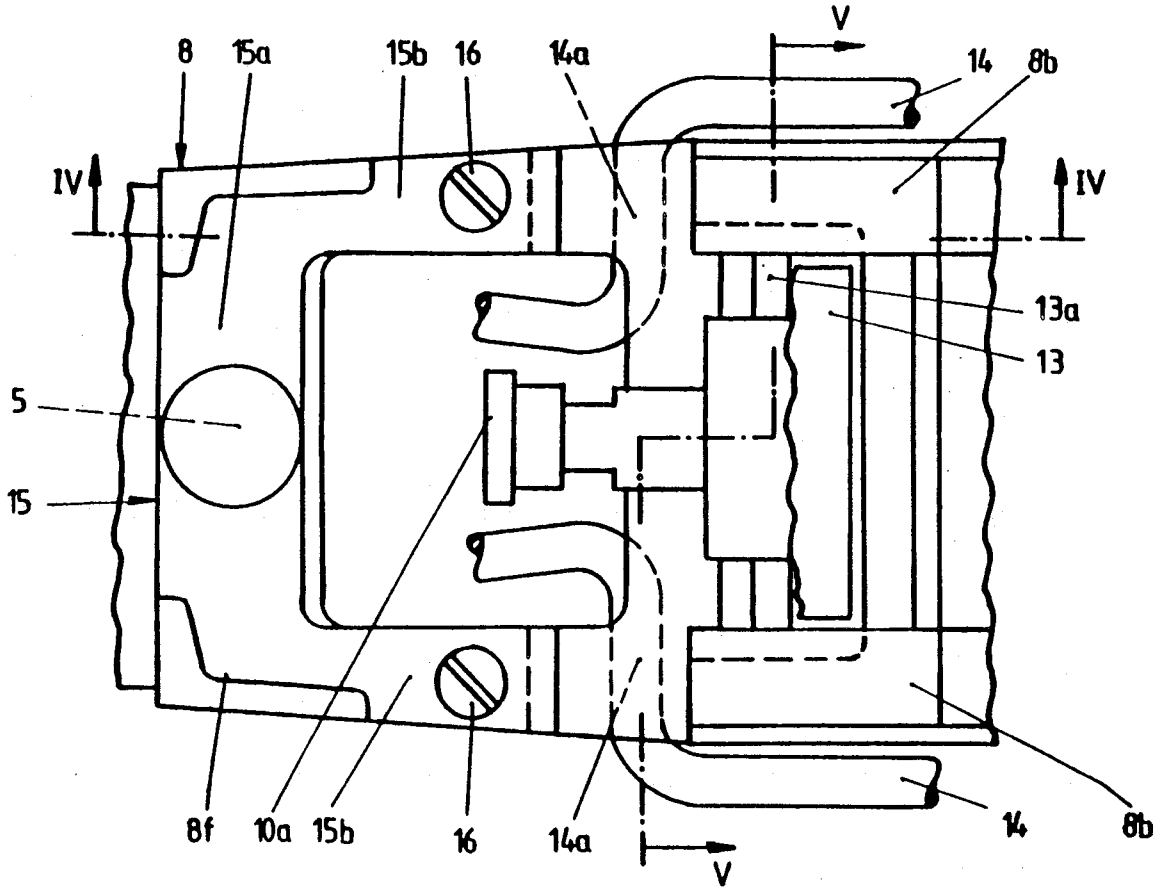

FIG. 3 is a plan view of the actuation pedal depicted in FIG. 2.

Figure 4:
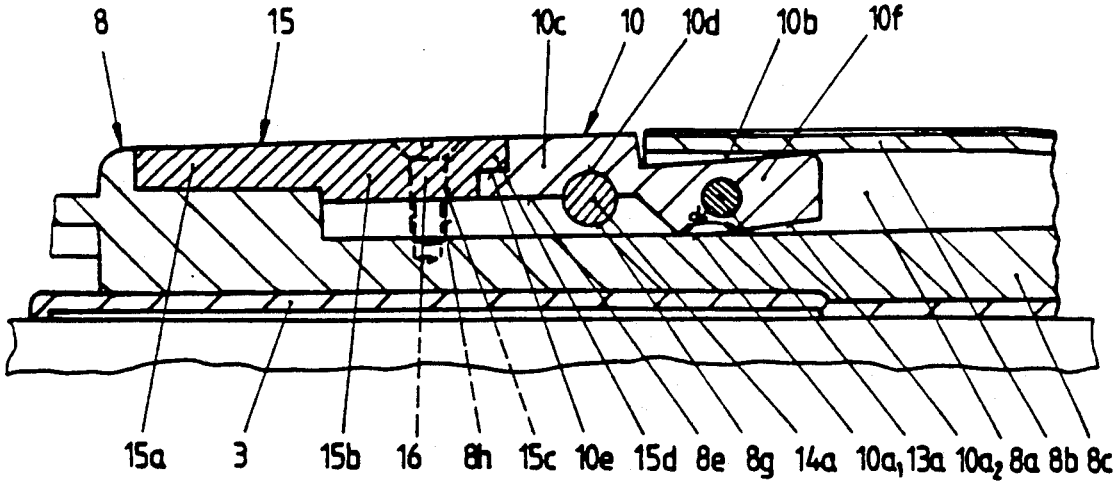
Figure 5:
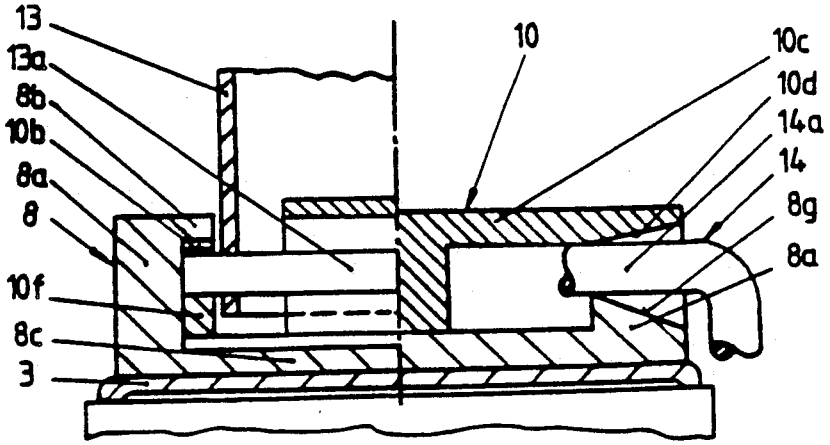

FIG. 4 is a longitudinal section taken along the line IV—IV of FIG. 3 and FIG. 5 is a cross section along the line V—V of FIG. 3.

DESCRIPTION OF THE PREFERRED EMBODIMENTS

Figure 1:
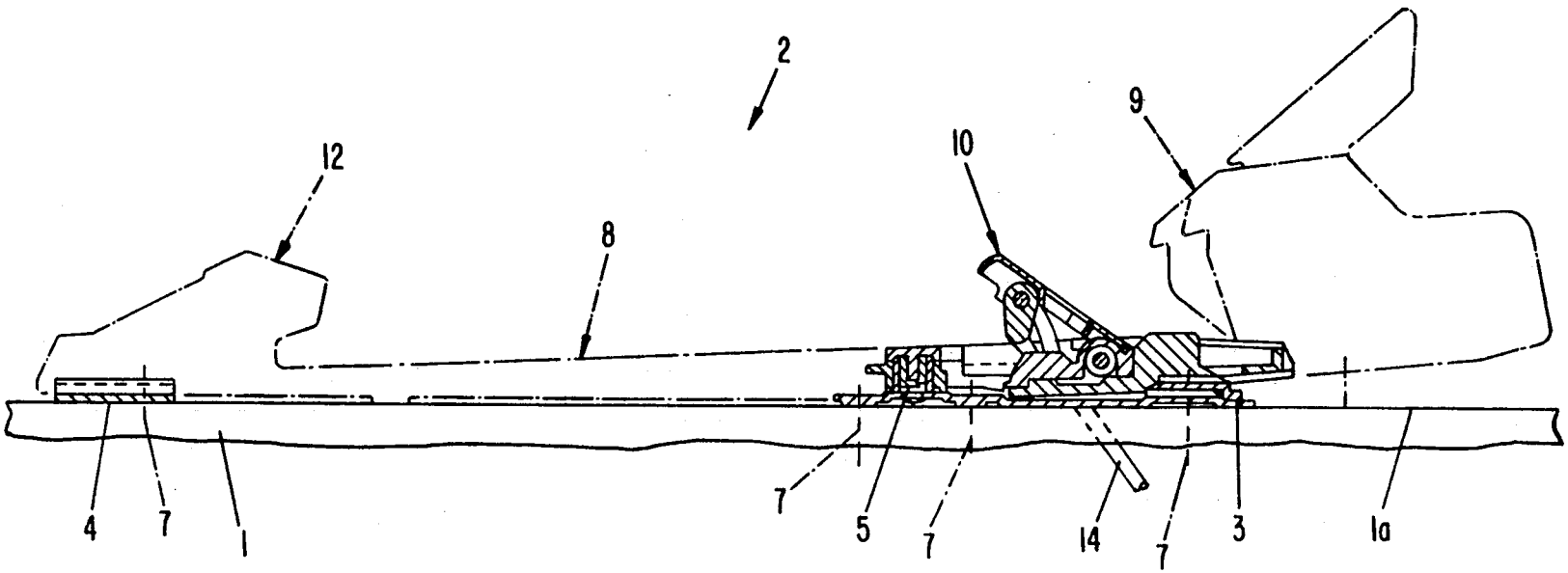
FIG. 1 is a partially sectioned side view of a touring ski binding with a ski brake; according to the invention.

In FIG. 1, a ski is denoted by 1, on which a ski binding, denoted overall by 2, is fastened. This ski binding 2 has in its rear region a mounting plate 3 and in its front region a base plate 4. The two plates 3 and 4 are screwed by means of screws 7 onto the upper side 1*a* of the ski 1. On the mounting plate 3 there is attached a pivot pin 5, which serves for the pivotal bearing of a sole plate 8. This bears at its rear end a heel holder 9, only indicated, and at its front end a toeholding unit 12, likewise only indicated. The configuration of the toeholding unit 12 and of the heel holder 9 does not in itself constitute a subject of the invention. For this reason, the particular structural design of these binding parts are not discussed in detail.

With reference to the other figures, an arrangement relating to the essence of the invention of a ski brake 10, essentially known per se, on the sole plate 8 is described in more detail below.

As shows, for example, in FIG. 5, in the region of this ski brake 10, the sole plate 8 is of U-shaped design in cross section. In the section of the sole plate 8 adjacent to the heel holder 9 there are in this case attached to the two members 8*a* of the U inwardly directed flanges 8*b*. As shown, for example, in FIG. 2*a*, on the web 8*c* of the sole plate 8 there is arranged an abutment 8*d*.

The ski brake 10 has a base plate 10*a*, in the side walls 10*f* of which the ends of the transverse axis 13*a* of an actuation pedal 13 (referred to below as pedal) are borne. In this case, the upper sides 10*b* of the side walls 10*f* run from the pivot axis 14*a* of two brake spikes 14, yet to be described in more detail, rising obliquely in the direction of the transverse axis 13*a* of the pedal 13. The side walls 10*f* extend in a region below the flanges 8*b* of the members 8*a* of the sole plate 8. In addition, the underside of the base plate 10*a* is bounded by two flat surfaces 10*a* and $10a_2$, which form with each other an obtuse angle $\alpha$. In this case, the distance between the underside $10a_1$, $10a_2$of the base plate 10*a* and the upper side 10*b* of the side walls 10*f* is kept essentially constant.

The two brake spikes 14 are multiply angled off, the central sections 14*a* of the same forming a pivot axis running transversely to the longitudinal direction of the sole plate 8 for the two brake spikes 14. Each section 14*a* is accommodated in a bearing split into two halves in a horizontal plane, which bearing widens outwards in the shape of a funnel in a way known per se. The lower half 8*g* of each bearing is located in an upwardly open recess 8*e* in the member 8*a* of the sole plate 8. The upper half 10*d* of each bearing on the other hand is hollowed out in an attachment extending outwards from the base plate 10*a*, which attachment forms the upper bearing shell 10*c* and comes to rest in the recess 8*e* of the sole plate 8. The attachment 10*c* is provided on the side adjacent to the pivot pin 5 with a stage 10*e*, on which the projection 15*d* of a clamping claw 15 rests. In this case, in the mounted state of the ski brake 10, the upper sides of the clamping claw 15 and of the two attachments 10*c* lie in a plane.

In the exemplary embodiment represented, the clamping claw 15 is of U-shaped design in plan view, the web 15*a* of the U being sunken in a transversely running hollow 8*f* of the sole plate 8. Bores 15*c* are hollowed out in the two members 15*b* of the clamping claw 15, which bores align with threaded bores 8*h* in the sole plate 8 and into which fastening screws 16 are inserted, the ends of which are anchored in the threaded bores 8*h*.

In the fitting of the ski brake 10 into the sole plate 8, firstly the base plate 10*a* is pushed in inclined position from the front into the recess in the sole plate 8, bounded by the two flanges 8*b*, the members 8*a* and the web 8*c*, until the base plate 10*a* is in contact with the abutment 8*d*. At the same time, the base plate 10*a* is pivoted downwards, so that the sections 14*a* of the two brake spikes 14 in the lower bearing halves 8*g* and the two attachments 10*c* of the base plate 10*a* come to rest in the two, upwardly open recesses 8*e* in the members 8*a* of the sole plate 8. In this case, the free ends of the upper sides 10*b* of the two side walls 10*f* come into contact with the underside of the flanges 8*b* of the members 8*a* of the sole plate 8. The opposite ends of the upper sides 10*b* on the other hand have play with respect to the two flanges 8*b*. The flat surfaces 10*a* and $10a_2$, which are arranged on the underside of the base plate 10*a* of the ski brake 10 and form with each other an obtuse angle $\alpha$, facilitate the pushing-in and the pivoting of the base plate 10*a*. Then, the clamping claw 15 is inserted into the stages 10*e* of the ski brake 10 and into the transversely running hollow 8*f* of the sole plate 8 and fastened by means of the fastening screws 16 on the sole plate 8.

If this ski brake 10 is to be exchanged for another one, it suffices to loosen the two fastening screws 16, to remove the clamping claw 15 and to replace the ski brake 10 by a new one, whereupon the mounting operation is repeated in the way already described.

The invention is not bound to the exemplary embodiment represented in the drawing and described above. Rather, various modifications of the same are possible without departing from the scope of the invention. For example, the clamping claw does not have to be of integral design. Rather, two mutually independent clamping claws could be used for the two attachments of the base plate of the ski brake. Instead of clamping claws for the fastening of the two upper bearing shells, screws may also be used, which pass through these bearing shells and are screwed into threaded bores of the sole plate.

We claim:

1. A ski binding for disposal on a sole plate which is pivotable on the upper surface of a ski, the ski binding comprising:

a ski brake including two brake arms pivotable about a pivot axis in a pivot opening;

a lower bearing mounted on the pivotable sole plate, said lower bearing including lower groove means, substantially U-shaped in cross-section, for receiving said brake arms;

an upper bearing removably mounted on said lower bearing, said upper bearing including upper groove means, substantially U-shaped in cross-section for cooperating with said lower groove means to define said pivot opening; and holding means for securing said upper bearing to said lower bearing, said holding means being selectively removable for allowing said brake arms to be removed from said pivot opening, said holding means having a first portion for engaging said upper bearing and a second portion connectable to the sole plate, said second portion including a depending web portion adapted to be received within a recessed member connected to said sole plate.

2. A ski binding as set forth in claim 1 wherein said holding means includes a clamping claw.

3. A ski binding as set forth in claim 1 wherein said sole plate includes a substantially U-shaped portion having upwardly extending legs, said lower bearing being disposed between said legs.

4. A ski binding as set forth in claim 1 further including a base plate and a bearing shell having an upper portion and a lower portion, said upper bearing being disposed in said upper portion and said lower bearing being disposed in said lower portion, said base plate connecting said upper and lower portions.

5. A ski binding as set forth in claims 4 wherein said holding means includes a clamping claw for securing said upper portion to said lower portion in a secured position, said bearing shell further including a stage portion for engagement with said clamping claw.

6. A ski binding as set forth in claim 5 wherein said bearing shell and said clamping claw each include an upper surface, said upper surfaces being substantially coplanar when said clamping claw is in said secured position.

7. A ski binding as set forth in either of claims 2 or 5 wherein said clamping claw is substantially U-shaped and includes a downwardly extending protrusion for disposal in an opening in the sole plate, said clamping claw further including bores for receiving screws to fasten said clamping claw to the sole plate.

8. A ski binding as set forth in claim 3 wherein said upwardly extending legs of the sole plate include inwardly protruding flanges disposed at distal ends thereof, said flanges for maintaining said lower bearing in a recess between said legs.

9. A ski binding as set forth in claim 4 wherein said base plate includes an obtusely angled lower surface.

10. A ski binding as set forth in claim 1 further including a pedal pivotably connect to said bearing shell about a first pivot axis, said brake arms being pivotable in said bearing shell about a second pivot axis, said brake arms being connected to said pedal such that pivotal movement of said pedal about said first pivot axis causes pivotal movement of said brake arms about said second pivot axis.

11. A ski binding as set forth in claim 10 wherein the bearing shell includes side walls extending transverse to said first pivot axis.

* * * * *